United States Patent [19]

Dunn

[11] 3,955,474

[45] May 11, 1976

[54] FLUID PRESSURE SYSTEM HAVING PUMPS AND VALVES

[75] Inventor: Donnell L. Dunn, Terre Haute, Ind.

[73] Assignee: J. I. Case Company, Racine, Wis.

[22] Filed: Mar. 19, 1975

[21] Appl. No.: 559,746

[52] U.S. Cl. ..... 91/414; 60/421; 60/427; 60/484; 60/486

[51] Int. Cl.[2] ..... F15B 13/06; F15B 13/09

[58] Field of Search ..... 60/420, 421, 427, 429, 60/486; 91/414

[56] References Cited

UNITED STATES PATENTS 2,052,182 8/1936 Le Bleu ..... 91/414 X 3,146,593 9/1964 Stacey ..... 60/421

*Primary Examiner*—Edgar W. Geoghegan

*Attorney, Agent, or Firm*—Arthur J. Hansmann

[57] ABSTRACT

A fluid pressure system having a plurality of pumps, valves, and fluid-pressure responsive units. These items are interconnected by fluid lines, and check valves are arranged to control the fluid in only certain directions in some portions of the lines. The entire arrangement permits the utilization of one pump for a respective fluid-pressure responsive unit, or all of the pumps can be directed to one of the fluid-pressure responsive units.

5 Claims, 2 Drawing Figures

FLUID PRESSURE SYSTEM HAVING PUMPS AND VALVES

This invention relates to a fluid pressure system having a plurality of pumps, valves, and fluid-pressure responsive units, whereby the pumps can supply fluid to respective ones of the valves, or the system can be controlled such that all pumps supply fluid to only one of the valves and thereby operate only one of the fluid-pressure responsive units.

BACKGROUND OF THE INVENTION

Fluid pressure systems are well known and commonly used in industry, and they exist in arrangements for utilizing gas and liquid as the fluid. It is particularly common to have a hydraulic system wherein there is a plurality of hydraulic pumps, valves, and cylinder assemblies or motors. One such prior art arrangement is shown in U.S. Pat. No. 2,768,499 which discloses a dual pump supplying two valves which in turn operate a plurality of hydraulic cylinder assemblies. However, the prior art is limited in its versatility and applications in that it does not have an arrangement including two or more pumps supplying fluid to a plurality of valves, either respectively or to only one of the valves, and with the valves in turn having fluid-responsive units, such as hydraulic cylinder assemblies or motors, operated by the valves. That is, the prior art does not provide for a system wherein all the pumps can supply pressure to only one fluid-responsive unit or motor nor can it be arranged to supply pressure to respective fluid-responsive units or motors. Accordingly, this is a primary advantage and objective of the present invention.

The present invention also provides a fluid pressure system utilizing a plurality of pumps, valves, and fluid-pressure responsive units in an arrangement wherein all sections of the system can operate independent of each other, or the several sections can be combined to have the combined output of all the pumps directed to one fluid-pressure responsive unit. Still further, the present invention accomplishes the aforementioned advantages and objectives in a simplified manner of arranging the elements, and with a minimal number of elements involved in this system.

Still further, the present invention provides a fluid pressure system wherein there is low neutral pressure drop, and there is also the accomplishment of slow or fast function speeds for operating the various fluid-pressure responsive units connected in the system. This advantage and objective is accomplished by being able to direct the output of the several pumps to respective fluid responsive units or to direct the combined output of all of the pumps to one of the fluid-pressure responsive units, and thereby create the multiple speed or different speed for the functioning of the fluid-pressure responsive units, such as hydraulic cylinders or motors.

Other objects and advantages will become apparent upon reading the following description in light of the accompanying drawings.

DETAILED DESCRIPTION OF THE PREFERRED EMBODIMENT

Figure 1:
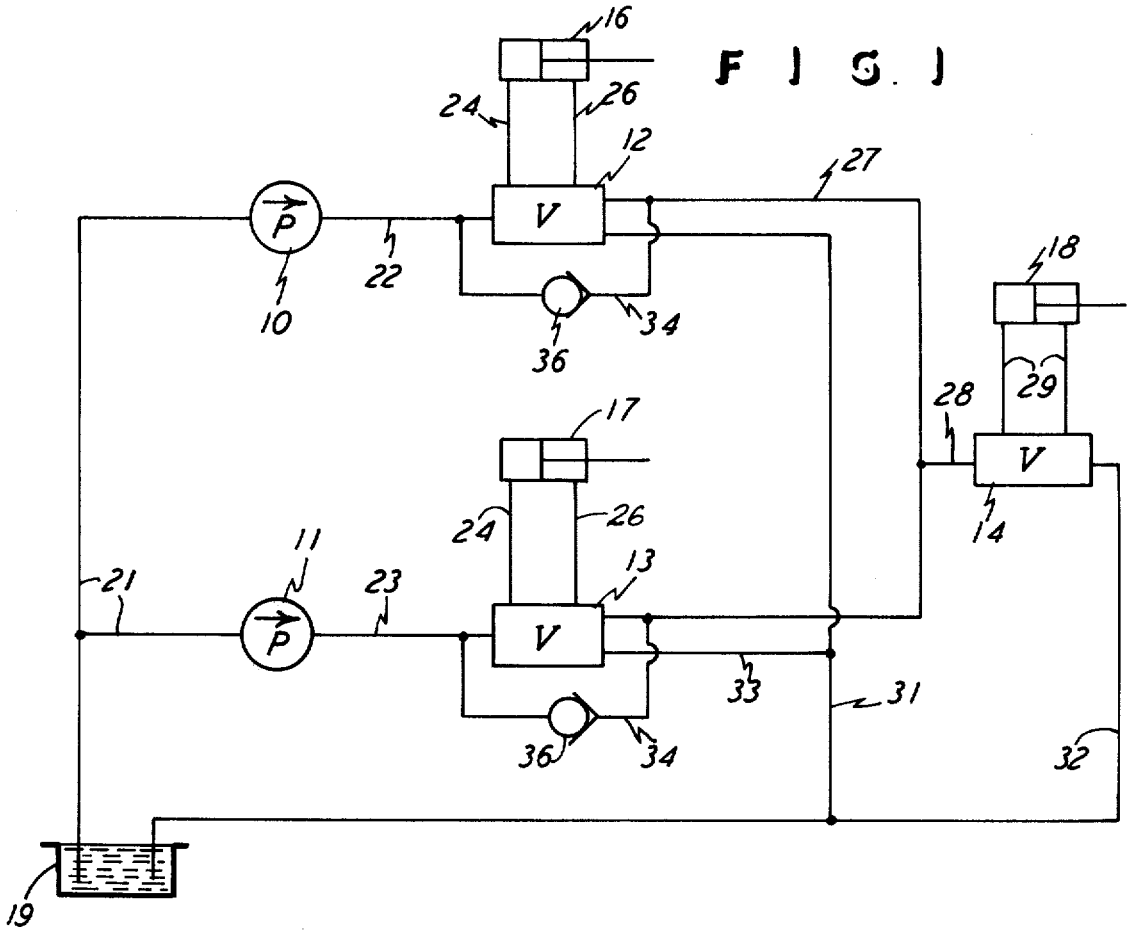
FIG. 1 is a diagrammatic view of the arrangement of the various elements incorporated in the fluid pressure system of this invention.

FIG. 1 shows the elements of this fluid pressure system, and it will be seen that there is generally shown two fluid pumps 10 and 11 and three fluid valves 12, 13 and 14, and three hydraulic cylinder assemblies 16, 17 and 18, and these are also designated fluid-pressure responsive units. The drawings further show the system has a reservoir 19 which could be used in an arrangement wherein liquid, such as oil, is the medium for the fluid of the system. A fluid-flow connection 21, such as a hydraulic line, extends to the pumps 10 and 11 to conduct fluid from the reservoir 19 and to those pumps. Fluid-flow connections 22 and 23 respectively extend between the pumps and the valves 12 and 13. Also, fluid-flow connections, again in the form of fluid lines of hoses or pipes or the like, designated 24 and 26, extend between the valves 12 and 13 and their connected units 16 and 17 which are shown in the form of cylinder assemblies having a cylinder and a movable piston and rod, all in a conventional arrangement of an assembly and being a two-way or double-acting type of assembly.

Further, a fluid-flow connection or line 27 extends between the valves 12 and 13, and it also connects to the valve 14 through the shown fluid-flow connection or line 28. Fluid-flow connections 29 extend between the valve 14 and the fluid-pressure responsive unit 18 which is also a double-acting type of fluid cylinder assembly, and the assemblies 16, 17 and 18 are thus operative in the form of and may be termed motors. Additionally, fluid-flow connections or lines 31 and 32 and 33 extend to conduct fluid from the three valves and back to the reservoir 19, at least where a hydraulic or liquid system is employed.

To complete the fluid-line connections, each of the valve units 12 has a by-pass type of connection designated 34 which connects between the respective inlet lines 22 and 23 and the outlet line or connection 27, to by-pass the respective valves 12 and 13, and a check valve 36 is in the line 34, for a purpose hereinafter described.

With the system as disclosed in FIG. 1, it will be seen and understood that the pumps 10 and 11 supply fluid under pressure to the respective valves 12 and 13, and, in turn, the fluid can be passed to the units 16 and 17 and it can also be passed to the outlet line 27 and thus to the valve 14, all depending upon the setting of the valves 12 and 13. Accordingly, there may be one setting condition wherein each pump 10 and 11 is supplying fluid to its respective valves 12 and 13 which in turn may be in a controlled or set position to supply fluid to its respective line 24 for operating the respective motor or units 16 and 17 in one direction, and the exhaust fluid of the units 16 and 17 can pass to the respective line 26 and back to the respective valves 12 and 13 and then to the line 27 and to line 28 and to the valve 14 which may be set in a position for passing fluid to either line 29 for either direction of energizing the unit 18, and finally the fluid can go through the return line 32 and back to the reservoir 19.

Secondly, any one of the three valves 12, 13 and 14 can be in a position for actuating its respective units 16, 17 or 18 in either direction, or the respective valve can be set so that its respective unit is not operated at all. For instance, if it were desired to operate units 17 and 18 but not operate unit 16, then fluid could be passed through the valve 12 and directly to the valve 14, all by virtue of the valving arrangement shown in FIG. 2. The inlet line 22 is designated in FIG. 2 and is shown to be in flow communication with a valve spool 37 which has a fluid passageway 38 arranged such that the left-hand end of the passageway 38, as viewed in FIG. 2, could be positioned aligned with the inlet line 22, and then the right-hand end of the passageway 38 would align with the valve outlet line 27, to thereby pass the fluid through the valve 12 and directly to the valve 14, for instance.

Figure 2:
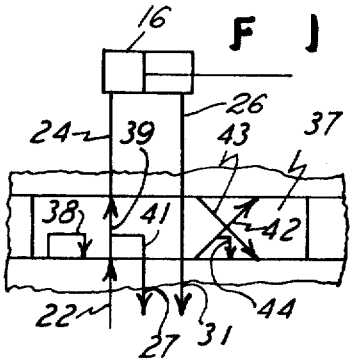
FIG. 2 is a schematic view showing a possible arrangement for the valves utilized in this system.

FIG. 2 then also shows that the spool 37 has a passageway 39 which can be aligned with the valve outlet or line 24, for passing the fluid to the unit 16, as indicated in FIG. 2. Further, in that alignment just described, the spool 37 has a loop passageway 41 which receives the inlet fluid from the line 22 and directs it to the outlet line 27 so that both the units 16 and 18, depending upon the setting of valve 14, can be supplied with fluid pressure.

A third arrangement for the system is such that only the valve 14 can be supplied with fluid pressure, and this would of course then mean that the valves 12 and 13, both of which can be arranged as shown in FIG. 2, would be in the position shifted rightwards to where the passageways 38 would be supplying the inlet fluid directly to the outlet line 27 and thence directly to the valve 14.

Fourthly, the system can be arranged such that the total effort of both pumps 10 and 11 can be directed to only one, but any one, of the three valves 12, 13 and 14. In that arrangement, both pumps 10 and 11 may be considered to be operating and supplying fluid to their respective valves 12 and 13, and, for instance, valve 12 may be set in the position shifted to the right to where the passageway 38 is diverting the flow directly to the line 27 which is of course connected with the line 34 which therefor directs the flow to the inlet line 23 and thence to the valve 13. Of course the flow can pass the check valve 36, because of the direction of the one-way check valve 36, as shown. Therefore, in that arrangement, the output of both pumps 10 and 11 can be directed to the valve 13, and the flow could then go to the drain line 33 and back to the reservoir 19.

Fifthly, the system could be arranged such that the total output of the pumps 10 and 11 could be directed to one of the valves 12 and 13, as just described, and also to the valve 14, depending upon the setting of the valve 14 with respect to the passage of fluid therethrough and to its connected outlet lines 29.

With the arrangements wherein the total output of the pumps is directed to only one or only two of the motor units 16, 17 and 18, as described above, then the units are operated faster and more forcefully.

Also, the valves 12 and 13 can be arranged for the double-acting action of their respective units 16 and 17, and this can be accomplished by virtue of the fluid passageways 42 and 43 shown in the spool 37, such that the passageway 42 can direct the flow from the inlet line 22 to the connected outlet line 26 and from the unit connected thereto the flow can be directed to the line 24 and back to the passageway 43 and then to the outlet or drain connection 31. Also, a cross-over or loop passageway 44 is in the spool 37, comparable to the passageway 38, so that the fluid can be passed to the other two valves, as described above in connection with the passageways 38 and 41.

What is claimed is:

1. In a fluid pressure system having two fluid pumps, a plurality of valves fluid-flow connected with said pumps, and a plurality of fluid-pressure responsive units fluid-flow connected with said valves for operation in response to the settings of said valves, the improvement comprising two of said valves being respectively fluid-flow connected with said pumps, two of said units being respectively fluid-flow connected with said two valves for operation of each of said units through fluid pressure created by a respective one of said pumps, a fluid-flow connection extending between said two valves for fluid-flow interconnecting said two valves, at least one of said two valves including a fluid-flow control member having a fluid passageway for directing the flow of fluid to said fluid-flow connection for applying the fluid flow from said one valve to the other of said valves, whereby the output of both said pumps is applied to said other valve, a third one of said valves fluid-flow connected with said fluid-flow connection for receiving fluid flowing through the first mentioned said two valves, and a third one of said fluid-pressure responsive units fluid-flow connected with said third valve, whereby said two pumps can optionally supply fluid solely to any one of said units or alternatively to all three of said units, at any time.

2. The fluid pressure system as claimed in claim 1, wherein said other valve includes a fluid inlet passage fluid-flow connected with its said pump, and said other valve includes a fluid outlet passage fluid-flow connected with said fluid-flow connection, and another fluid flow connection fluid-flow connected with the first-mentioned and said fluid-flow connection and with said fluid inlet passage.

3. The fluid pressure system as claimed in claim 2, including a check valve in the path of flow of fluid in said another fluid-flow connection, for allowing the one-way flow of fluid to said other valve.

4. In a fluid pressure system having two fluid pumps, a plurality of valves fluid-flow connected with said pumps, and a plurality of fluid-pressure responsive units fluid-flow connected with said valves for operation in response to the settings of said valves, the improvement comprising two of said valves being respectively fluid-flow connected with said pumps, two of said units being respectively fluid-flow connected with said two valves for operation of each of said units through fluid pressure created by a respective one of said pumps, a fluid-flow connection extending between said two valves for fluid-flow interconnecting said two valves, at least one of said two valves including a fluid-flow control member having a fluid passageway for directing the flow of fluid to said fluid-flow connection for applying the fluid flow from said one valve to the other of said valves, whereby the output of both said pumps is applied to said other valve, both said valves having a fluid inlet passage fluid-flow connected with its said pump, and said valves including a fluid-flow control member having a fluid passageway for directing the flow of fluid to said fluid-flow connection, and a respective check valve fluid-flow connected between each said inlet passage and said fluid-flow connection whereby the total outlet of both said pumps may be applied to either of said valves.

5. The fluid pressure system as claimed in claim 4, wherein said plurality of valves includes three said valves, the third one of said valves being fluid-flow connected with said fluid-flow connection for receiving fluid flowing through said two valves, and a third said fluid-pressure responsive unit fluid-flow connected with said third valve, whereby said two pumps can optionally supply fluid to any one solely, or alternatively to all three, of said units at any time.

* * * * *